US006286295B1

(12) United States Patent
Lang

(10) Patent No.: US 6,286,295 B1
(45) Date of Patent: Sep. 11, 2001

(54) YARN WITHDRAWAL NOZZLE FOR AN OPEN-END ROTOR SPINNING APPARATUS

(75) Inventor: Kurt Lang, Lauterstein (DE)

(73) Assignees: Fritz Stahlecker, Bad Überkingen; Hans Stahlecker, Süussen, both of (DE)

( * ) Notice: Subject to any disclaimer, the term of this patent is extended or adjusted under 35 U.S.C. 154(b) by 0 days.

(21) Appl. No.: 09/480,679

(22) Filed: Jan. 11, 2000

(30) Foreign Application Priority Data

Jan. 14, 1999 (DE) ..... 199 01 147

(51) Int. Cl.[7] ..... D01H 4/40; D01H 4/08
(52) U.S. Cl. ..... 57/417; 57/416
(58) Field of Search ..... 57/416, 417

(56) References Cited

U.S. PATENT DOCUMENTS

| | | | | |
|---|---|---|---|---|
| 3,930,356 | | 1/1976 | Nagel et al. | 57/58.95 |
| 4,068,456 | * | 1/1978 | Landwehrkamp | 57/58.89 |
| 4,791,781 | * | 12/1988 | Phoa et al. | 57/417 |
| 5,265,406 | | 11/1993 | Hofmann et al. | 57/417 |
| 5,321,943 | | 6/1994 | Schmid et al. | 57/417 |
| 5,603,210 | * | 2/1997 | Didek et al. | 57/408 |
| 5,666,799 | | 9/1997 | Phoa et al. | 57/417 |

FOREIGN PATENT DOCUMENTS

| | | |
|---|---|---|
| 24 10 940 | 9/1974 | (DE) . |
| 32 39 289 | 4/1984 | (DE) . |

* cited by examiner

*Primary Examiner*—Andy Falik
(74) *Attorney, Agent, or Firm*—Crowell & Moring LLP

(57) ABSTRACT

A yarn withdrawal nozzle for an open-end rotor spinning apparatus comprises a short, funnel-shaped yarn deflecting surface, which begins at a plane front surface and graduates into a yarn withdrawal channel. The radius of curvature of the yarn deflecting surface measures a maximum of 3 mm. The front surface is formed as a tangential surface to the yarn deflecting surface, The small radius of curvature facilitates in particular the spinning of polyester yarns at a high rotor speed.

34 Claims, 1 Drawing Sheet

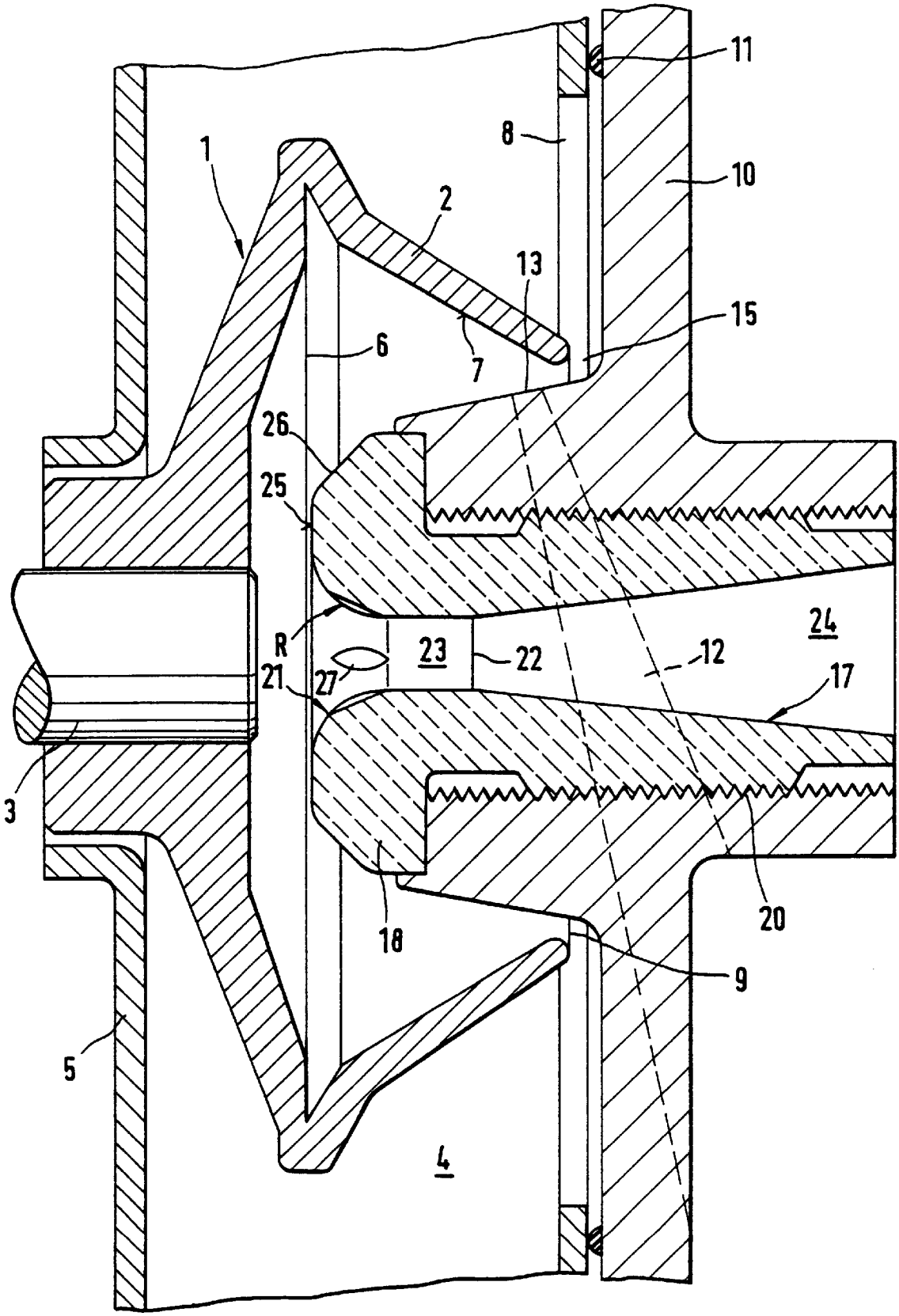
11
8
10
1
2
13
15
6
7
26
25
R
23
22
24
12
21
27
17
3
18
20
9
5
4

YARN WITHDRAWAL NOZZLE FOR AN OPEN-END ROTOR SPINNING APPARATUS

BACKGROUND AND SUMMARY OF THE INVENTION

This application claims the priority of German application 199 01 147.8, filed in Germany on Jan. 14, 1999, the disclosure(s) of which is (are) expressly incorporated by reference herein.

The present invention relates to a yarn withdrawal nozzle for an open-end rotor spinning apparatus having a short funnel-shaped yarn deflecting surface, which begins at a plane front surface and graduates into a yarn withdrawal channel.

Open-end rotor spinning apparatus run today at spinning rotor speeds of 130,000 rpm and more. In the processing of synthetic fibers, in particular polyester fibers, or of mixtures of natural and synthetic fibers, the operating speeds are, however, limited. This is because heat damage caused by frictional heat occurs in the synthetic fibers. This damage caused by overheating is particularly noticeable at the yarn withdrawal nozzle, as the spun yarn rotates crank-like at high speeds there and is pressed onto the yarn deflecting surface of the yarn withdrawal nozzle.

Many ideas as to how to reduce overheating at the yarn withdrawal nozzle have already been tried and tested.

German published patent 24 10 940 suggests directing a cooling air stream onto a yarn guiding funnel, which is similar to a yarn withdrawal nozzle. Here the cooling air stream is the outside surrounding air which penetrates into the inside of the rotor spinning apparatus. This idea was never put into commercial practice.

In U.S. Pat. No. 3,930,356, it is suggested that conditioned air be used as transport air for the fibers transported from the opening device to the spinning rotor, and that this conditioned air be used to cool the yarn delivery area. The frictional heat generated by the thread is thus presumed to be drawn off. Again, this idea was never put into commercial practice.

According to a further idea in U.S. Pat. No. 5,666,799, it is intended that the yarn withdrawal nozzle is cooled by designing a double-walled channel plate, to which the yarn withdrawal nozzle is applied. The arising free space is then connected to a coolant loop. This design is very complicated and was never put into commercial practice.

A yarn withdrawal nozzle is described in U.S. Pat. No. 5,265,406, in which a material having high heat conducting properties is inserted between the wear-resistant, yarn deflecting surfaces and a take-up of the yarn withdrawal nozzle. 5 The heat from the yarn-guiding surfaces is thus presumed to be quickly drawn off. As the yarn-guiding surfaces are not good heat conductors, practically no rapid drawing off of heat occurs in any case at those points where overheating really occurs.

According to U.S. Pat. No. 5,321,943, it is therefore provided that the yarn-guiding surfaces of a yarn withdrawal nozzle are made from a wear-resistant material having high heat-conducting properties, for example titanium diboride. It has been shown, however, that the chosen material does not necessarily possess good spinning properties.

Finally, according to German published patent 32 39 289, the yarn, deflected at the yarn withdrawal nozzle, exerts a surface pressure only on a contact surface which is curved, like an arc of a circle, in axial cross section, which contact surface is, in comparison to other yarn withdrawal nozzles, relatively short. The contact surface is deliberately shortened in that the beginning of the arc, for which a radius of 4 mm is given, is cut off by a secant. The aim of these measures is to reduce the axial forces of the withdrawn yarn. The contact surface begins with a clearly defined edge, at which the yarn drawn off from the spinning rotor comes into contact with the yarn withdrawal nozzle for the first time. There is no reference to the reduction of heat damage in this publication.

It is an object of the present invention to design the simplest yarn withdrawal nozzle possible with which synthetic fibers can be spun at higher speeds than before without resorting to additional complicated measures.

This object has been achieved in accordance with the present invention in that the radius of curvature measures a maximum of 3 mm and that the front surface takes the form of a surface tangential to the yarn deflecting surface.

It has surprisingly been shown that, by means of the significant reduction in the radius of curvature in comparison to known yarn withdrawal nozzles, heat damage in the case of synthetic fibers, in particular polyester fibers, can be reduced. It has been shown that spinning can take place at approximately 15% higher speed and thus with 15% higher delivery than if a previously standard radius of curvature, in the range of 6 mm and more, is used. In spite of the increased surface pressure caused by the small radius of curvature, the desired effect occurs probably because the yarn deflecting surface is extremely short, so that the deflected yarn leaves the yarn deflecting surface again before any heat damage can occur. Because the front surface takes the form of a tangential surface to the yarn deflecting surface, the yarn drawn off from the spinning rotor does not come into contact with an edge. The front surface is practically exempted from any surface pressure, but forms for the yarn a kind of supporting guiding surface.

The yarn deflecting surface graduates advantageously without a distinct edge continuously into a hollow cylindrical part of the yarn withdrawal channel. Thus additional increased surface pressure caused by any deflecting edges is avoided.

For reasons of technical production, it is purposeful when the radius of curvature of the yarn deflecting surface is constant throughout.

The outer diameter of the front surface is limited to only what is absolutely necessary, and measures advantageously a maximum of 10 mm. In order to reduce friction, the yarn deflecting surface and the front surface are both polished smooth. The front surface graduates advantageously at the outer diameter into a conical ring surface, with which the yarn does not come into contact, that is, which is staggered in relation to the yarn running plane.

It can be additionally provided that the yarn deflecting surface is provided in a known way with notches. Thus the false twist, which occurs at the yarn deflecting surface, is periodically interrupted, so that the generated false twist can "jump back" so to speak from time to time.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a sectional I,o view of a portion of a rotor open-end spinning assembly constructed in accordance with preferred embodiments of the present invention.

DETAILED DESCRIPTION OF THE DRAWING

The partly shown open-end rotor spinning apparatus comprises a spinning rotor assembly 1, which consists of a rotor cup 2 and a pressed in shaft 3. The shaft 3 is supported and driven in a way not shown.

The rotor cup 2 rotates in a vacuum chamber 4, which is formed by a rotor housing 5, which is connected to a vacuum source in a way not shown.

The rotor cup 2 comprises a fiber sliding surface 7 which extends conically towards a fiber collecting groove 6. The hollow inside of the rotor cup 2 has its largest diameter in the fiber collecting groove 6. The spinning rotor 1 can be pulled out through a front opening 8 of the rotor housing 5 to the operator's side. During operation, the opening 8 of the rotor housing 5, together with the open front side 9 of the rotor cup 2 is closed by means of a covering 10 which can be moved away. The covering 10 is disposed on the rotor housing 5 with a ring sealing 11 therebetween.

The covering 10 comprises a fiber feed channel 12 arranged outside the plane of projection, which begins at an opening roller (not shown) in the known way and whose mouth 13 is directed opposite the fiber sliding surface 7. By means of the effect of the above mentioned vacuum source, fibers opened by the opening roller are shot through the fiber feed channel 12 against the fiber sliding surface 7, from where they slide into the fiber collecting groove 6, form a fiber ring there and are then drawn off in a known way as a yarn in axial direction of the shaft 3. The transport air sucked in through the fiber feed channel 12 can stream out through an overflow gap 15 at the open front side 9 of the spinning rotor 1.

The spun yarn is drawn out of the fiber collecting groove 6 at least approximately in a normal plane to the shaft 3 of the spinning rotor 1 and drawn off though a yarn withdrawal channel 17 of a yarn withdrawal nozzle 18 by means of a delivery roller pair (not shown) and fed to a winding bobbin (also not shown). The yarn withdrawal channel 17 is disposed coaxially to the shaft 3 of the spinning rotor 1, so that the yarn is deflected by approximately 90° by means of the yarn withdrawal nozzle 18, whereby the yarn in the above mentioned normal plane rotates crank-like. The yarn withdrawal nozzle 18 is screwed into a corresponding bore hole of the covering 10 by means of an outer thread 20.

A funnel-shaped yarn deflecting surface 21 serves to deflect the yarn from the normal plane into the yarn withdrawal channel 17. In the axial section shown, the yarn deflecting surface 21 is a surface curved in an arc of a circle, which is directly upstream of the smallest cross section 22 of the yarn withdrawal channel 17. In the axial section shown, the yarn deflecting surface 21 forms a quarter circle having a radius of curvature R, which measures a maximum of 3 mm and preferably only 2.5 mm. This radius of curvature R is significantly smaller than in standard yarn withdrawal nozzles used in practice up to now. A hollow cylindrical part 23 of the yarn withdrawal channel 17 having a diameter corresponding to the smallest cross section 22 is arranged downstream of the yarn deflecting surface 21. The yarn withdrawal channel 17 is extended alongside of a slightly conical area 24.

The deflected thread, circulating crank-like on the yarn deflecting surface 21, is heated at this point by frictional heat to a great extent. This is in particular critical when the fiber material to be spun involves certain synthetic fibers, in particular polyester fibers. These fibers are damaged when the yarn deflecting surface 21 overheats. In practice, the usual measures taken up to now were to reduce the upper limit of the speed of the spinning rotor 1 in comparison to the upper speed limit in the case of other fiber materials.

Now, however, it is an object of the present invention that polyester fibers are also spun at higher speeds, whereby even the smallest speed increase is advantageous. It is now recognized that the damage to the synthetic fibers caused by overheating is reduced when the yarn deflecting surface 21 is as short as possible. A somewhat greater surface pressure at this point can hereby even be taken into consideration. It is provided in the present invention that the radius of curvature R of the yarn deflecting surface 21 measures a maximum of 3 mm and preferably 2.5 mm. It is hereby favorable when a guiding surface is provided upstream of the yarn deflecting surface 21, which guiding surface supports the crank-like circulating yarn in a certain way, but which is, however, practically exempted from a noticeable surface pressure. For this reason, the front surface 25 of the yarn withdrawal nozzle 18 takes the form of a tangential surface to the yarn deflecting surface 21.

The yarn deflecting surface 21 begins at the front surface 25 and graduates continuously into the hollow cylindrical part 23 of the yarn withdrawal channel 17. The yarn deflecting surface 21 is not defined at its beginning nor its end by any deflecting edges. The radius R is preferably constant all the way through. The outer diameter of the front surface 25 should be as small as possible and measures in practice approximately 10 mm. The front surface 25 as well as the yarn deflecting surface 21 of the ceramic yarn withdrawal nozzle 18 are polished.

A slightly conical ring surface 26 adjoins the outer diameter of the front surface 25, which ring surface 26 is inclined going away from the fiber collecting groove 6 and which does not come into contact with the yarn.

In a known way, the yarn deflecting surface 21 can be provided with notches 27. By means of the notches 27, the false twist, which is unavoidably initiated and which is even desirable for spinning stability, is periodically interrupted, so that the false twist "springs back" so to speak from time to time. Because of the very small radius R, the notches 27 should not be as extreme as in the case of known yarn withdrawal nozzles.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A yarn withdrawal nozzle for an open-end rotor spinning apparatus having a short funnel-shaped yarn deflecting surface, which begins at a plane front surface and graduates into a yarn withdrawal channel, wherein the radius of curvature of the yarn deflecting surface measures a maximum of 3 mm and wherein the front surface is in the form of a tangential surface to the yarn deflecting surface.

2. A yarn withdrawal nozzle according to claim 1, wherein the yarn deflecting surface graduates continuously into a hollow cylindrical part of the yarn withdrawal channel.

3. A yarn withdrawal nozzle according to claim 2, wherein the radius of curvature of the yarn deflecting surface is constant.

4. A yarn withdrawal nozzle according to claim 2, wherein the front surface is a yarn-supporting guiding surface.

5. A yarn withdrawal nozzle according to claim 2, wherein the outer diameter of the front surface measures a maximum of 10 mm.

6. A yarn withdrawal nozzle according to claim 2, wherein the yarn deflecting surface is provided with notches.

7. A yarn withdrawal nozzle according to claim 2, wherein the yarn deflecting surface and the front surface are polished.

8. A yarn withdrawal nozzle according to claim 2, wherein the front surface graduates at an outer diameter into a conical ring surface with which the yarn does not come into contact during use of the nozzle.

9. A yarn withdrawal nozzle according to claim 1, wherein the radius of curvature of the yarn deflecting surface is constant all the way through.

10. A yarn withdrawal nozzle according to claim 9, wherein the front surface is a yarn-supporting guiding surface.

11. A yarn withdrawal nozzle according to claim 9, wherein the outer diameter of the front surface measures a maximum of 10 mm.

12. A yarn withdrawal nozzle according to claim 9, wherein the yarn deflecting surface is provided with notches.

13. A yarn withdrawal nozzle according to claim 9, wherein the yarn deflecting surface and the front surface are polished.

14. A yarn withdrawal nozzle according to claim 9, wherein the front surface graduates at an outer diameter into a conical ring surface with which the yarn does not come into contact during use of the nozzle.

15. A yarn withdrawal nozzle according to claim 1, wherein the front surface is a yarn-supporting guiding surface.

16. A yarn withdrawal nozzle according to claim 15, wherein the outer diameter of the front surface measures a maximum of 10 mm.

17. A yarn withdrawal nozzle according to claim 15, wherein the yarn deflecting surface is provided with notches.

18. A yarn withdrawal nozzle according to claim 15, wherein the yarn deflecting surface and the front surface are polished.

19. A yarn withdrawal nozzle according to claim 15, wherein the front surface graduates at an outer diameter into a conical ring surface with which the yarn does not come into contact during use of the nozzle.

20. A yarn withdrawal nozzle according to claim 1, wherein the outer diameter of the front surface measures a maximum of 10 mm.

21. A yarn withdrawal nozzle according to claim 20, wherein the yarn deflecting surface is provided with notches.

22. A yarn withdrawal nozzle according to claim 20, wherein the yarn deflecting surface and the front surface are polished.

23. A yarn withdrawal nozzle according to claim 20, wherein the front surface graduates at an outer diameter into a conical ring surface with which the yarn does not come into contact during use of the nozzle.

24. A yarn withdrawal nozzle according to claim 1, wherein the yarn deflecting surface is provided with notches.

25. A yarn withdrawal nozzle according to claim 24, wherein the yarn deflecting surface and the front surface are polished.

26. A yarn withdrawal nozzle according to claim 24, wherein the front surface graduates at an outer diameter into a conical ring surface with which the yarn does not come into contact during use of the nozzle.

27. A yarn withdrawal nozzle according to claim 1, wherein the yarn deflecting surface and the front surface are polished.

28. A yarn withdrawal nozzle according to claim 27, wherein the front surface graduates at an outer diameter into a conical ring surface with which the yarn does not come into contact during use of the nozzle.

29. A yarn withdrawal nozzle according to claim 1, wherein the front surface graduates at the outer diameter into a conical ring surface with which the yarn does not come into contact during use of the nozzle.

30. A yarn withdrawal nozzle according to claim 1, wherein the withdrawal nozzle is made of ceramic material.

31. An open-end rotor spinning assembly comprising:

a spinning rotor, a movable cover including portions of a fiber feed channel operable to feed open-end fibers into the rotor, and a yarn withdrawal nozzle carried by the cover and operable, to accommodate withdrawal of yarn from the rotor, wherein the yarn withdrawal nozzle has a short funnel-shaped yarn deflecting surface, which begins at a plane front surface and graduates into a yarn withdrawal channel, wherein the radius of curvature of the yarn deflecting surface measures a maximum of 3 mm and wherein the front surface is in the form of a tangential surface to the yarn deflecting surface.

32. A method of making synthetic fiber yarn comprising:

feeding synthetic open-end fibers to a spinning rotor rotating at a rotating speed of more than 100,000 revolutions per minute, withdrawing spun yarn from the spinning rotor through a yarn withdrawal nozzle, providing said nozzle with a short funnel-shaped yarn deflecting surface, which begins at a plane front surface and graduates into a yarn withdrawal channel, wherein the radius of curvature of the yarn deflecting surface measures a maximum of 3 mm and wherein the front surface is in the form of a tangential surface to the yarn deflecting surface.

33. A method according to claim 32, further comprising the steps of rotating the spinning rotor at speeds above 130,000 revolutions per minute, and providing the yarn withdrawal nozzle with polished yarn deflecting and front surfaces.

34. A method according to claim 32, wherein the front surface is a yarn-supporting guiding surface which is practically excluded from any surface pressure from yarn being withdrawn during use.

* * * * *